US011246421B2

(12) United States Patent
Cai et al.

(10) Patent No.: US 11,246,421 B2
(45) Date of Patent: Feb. 15, 2022

(54) BREATHABLE CUSHION

(71) Applicant: Shanghai Bedsure Tech Co., LTD, Shanghai (CN)

(72) Inventors: Zongde Cai, Shanghai (CN); Mi Xiang, Shanghai (CN)

(73) Assignee: Shanghai Bedsure Tech Co., LTD, Shanghai (CN)

( * ) Notice: Subject to any disclaimer, the term of this patent is extended or adjusted under 35 U.S.C. 154(b) by 0 days.

(21) Appl. No.: 17/036,198

(22) Filed: Sep. 29, 2020

(65) Prior Publication Data

US 2021/0127842 A1 May 6, 2021

(30) Foreign Application Priority Data

Nov. 4, 2019 (CN) ..... 201921876691.6

(51) Int. Cl.
*A47C 7/02* (2006.01)
*A47C 7/74* (2006.01)
*A47C 7/34* (2006.01)

(52) U.S. Cl.
CPC ..... *A47C 7/746* (2013.01); *A47C 7/029* (2018.08); *A47C 7/34* (2013.01)

(58) Field of Classification Search
CPC ..... A47C 7/029; A47C 7/34; A47C 7/746
USPC ..... 297/452.21–452.28, 452.42, 452.48
See application file for complete search history.

(56) References Cited

U.S. PATENT DOCUMENTS 4,698,864 A * 10/1987 Graebe ..... A47C 27/081 297/DIG. 3
5,402,545 A * 4/1995 Jolley ..... A61G 5/1043 5/653
5,628,079 A * 5/1997 Kizemchuk ..... A47C 3/16 297/219.1 X
5,918,334 A * 7/1999 Laidlaw ..... A61G 7/05715 297/452.25 X
6,142,573 A * 11/2000 Harding ..... A61G 5/1043 297/452.25
6,547,327 B1 4/2003 Yates
(Continued)

FOREIGN PATENT DOCUMENTS

KR 2019026087 A * 3/2019 ..... A47C 7/029
WO WO-2020214978 A1 * 10/2020 ..... A47C 7/18

*Primary Examiner* — Rodney B White
(74) *Attorney, Agent, or Firm* — Locke Lord LLP; Tim Tingkang Xia, Esq.

(57) ABSTRACT

The present disclosure relates to a breathable cushion. The cushion includes a thigh support portion, a hip support portion, and a waist and back support portion. The thigh support portion includes a plurality of thigh support structures each having an opening structure; the hip support portion includes a plurality of hip support structures each having an opening structure; and the waist and back support portion includes a plurality of waist and back support structures each having an opening structure. The area of the opening structures of the thigh support structures and/or the area of the opening structures of the waist and back support structures is greater than the area of the opening structures of the hip support structures. The cushion has the following advantages. The cushion has an ergonomic design and structure, and provides reasonable and reliable supports. In addition, the light-weight and highly comfortable cushion has good air permeability.

9 Claims, 6 Drawing Sheets

(56) References Cited

U.S. PATENT DOCUMENTS

| | | | | |
|---|---|---|---|---|
| 6,625,830 | B2 * | 9/2003 | Lampel | A47C 27/146 297/452.26 |
| 7,717,520 | B2 * | 5/2010 | Boren | B64D 11/0647 297/452.48 |
| 7,850,247 | B2 * | 12/2010 | Stauske | B60N 2/0228 297/452.24 X |
| 9,332,850 | B2 * | 5/2016 | Krishtul | A47C 7/029 |
| 9,609,951 | B2 * | 4/2017 | Chan | A47C 7/35 |
| 9,763,522 | B2 * | 9/2017 | Siekman | A47C 7/02 |
| 2010/0314929 | A1 * | 12/2010 | Hsu | A47C 27/15 297/452.48 |
| 2010/0327636 | A1 * | 12/2010 | Stoll | B60N 2/5685 297/180.1 |
| 2013/0193738 | A1 * | 8/2013 | Siekman | A47C 7/029 297/452.56 |
| 2013/0198961 | A1 * | 8/2013 | Davis | A47C 7/18 5/648 |
| 2014/0182049 | A1 * | 7/2014 | Prust | A42B 3/10 2/410 |
| 2016/0007671 | A1 * | 1/2016 | Prust | A47C 27/007 297/219.11 X |
| 2017/0000264 | A1 * | 1/2017 | Krishtul | A47C 7/021 |

* cited by examiner

BREATHABLE CUSHION

CROSS-REFERENCE TO RELATED PATENT APPLICATION

This non-provisional application claims priority to and the benefit of, pursuant to 35 U.S.C. § 119(a), patent application Serial No. CN201921876691.6 filed in China on Nov. 4, 2019. The disclosure of the above application is incorporated herein in its entirety by reference.

TECHNICAL FIELD

The present disclosure relates to the technical field of the articles for daily use, and in particular, relates to a breathable cushion.

BACKGROUND

With the continuous improvement of the society, more and more people sit for a longer and longer time. They usually sit in the office for long-term working, or sit in front of computers or televisions for leisure and entertainment. As is known to all, maintaining a sitting posture for a long time is harmful to the health of human body, which usually causes symptoms of waist sourness and back pain.

Therefore, people typically choose cushions to make it easy to maintain a long-term sitting posture.

However, conventional cushions usually fail to well support human bodies, and are stuffy and unbreathable. As such, the user does not feel comfortable enough when sitting on such conventional cushions.

Accordingly, there is a need to develop a breathable cushion to address the above problems.

SUMMARY

To overcome the defects in the related art, the present disclosure provides a breathable cushion. The cushion has the following advantages. The cushion has an ergonomic design and structure, and provides reasonable and reliable supports. In addition, the light-weight and highly comfortable cushion has good air permeability.

One aspect of the present disclosure provides a breathable cushion. The breathable cushion includes a thigh support portion, a hip support portion, and a waist and back support portion. The thigh support portion includes a plurality of thigh support structures each having an opening structure; the hip support portion includes a plurality of hip support structures each having an opening structure; and the waist and back support portion includes a plurality of waist and back support structures each having an opening structure. The number of the thigh support structures within a unit area and/or the number of the waist and back support structures within a unit area is less than the number of the hip support structures within a unit area.

In some embodiments, the opening structures of the thigh support structure, the hip support structure, and/or the waist and back support structure all include a honeycomb opening.

In some embodiments, the opening structures of at least a part of the waist and back support structure further include a cross-shaped support reinforcement structure.

In some embodiments, an upper surface of the thigh support portion and an upper surface of the hip support portion both further include a plurality of through holes longitudinally passing therethrough.

In some embodiments, the cushion further includes a transverse through hole transversely passing through the thigh support portion and the hip support portion, wherein the transverse through hole communicates at least a part of the longitudinal through holes with air.

In some embodiments, an upper surface of the hip support portion further includes a plurality of protrusion portions.

In some embodiments, a thickness of at least a part of the thigh support portion is greater than a thickness of the hip support portion.

In some embodiments, a thickness of at least a part of the waist and back support portion is greater than a thickness of the hip support portion.

In some embodiments, the breathable cushion is integrally formed using a thermoplastic elastomer material.

In some embodiments, the breathable cushion further includes a cushion surface structure, wherein the cushion surface structure is formed by interconnecting upper portions of the thigh support portion, the hip support portion, and the waist and back support portion, and the cushion surface structure includes a relatively smooth and curved surface.

BRIEF DESCRIPTION OF THE DRAWINGS

For better understanding of the present disclosure, embodiments of the present disclosure are described hereinafter with reference to the accompanying drawings. Among the drawings.

REFERENCE NUMERALS AND DENOTATIONS THEREOF

100: cushion;
10: thigh support portion;
11: thigh support structure;
20: hip support portion;
21: hip support structure;
30: waist and back support portion;
31: waist and back support structure;
32: cross-shaped support reinforcement structure;
40: cushion surface structure;
41: longitudinal through hole;
42: transverse through hole;
43: protrusion portion;
44: saddle-shaped protrusion.

DETAILED DESCRIPTION

Unless otherwise specified, the technical terms and scientific terms used in the specification and claims shall express general meanings that may be understood by a person skilled in the technical field of the present disclosure. All the values between a minimum value and a maximum value listed herein refer to all the values obtained in increments of one unit between the minimum value and the maximum value when at least two units are present between the minimum value and the maximum value.

Specific embodiments of the present disclosure are described hereinafter with reference to the specific drawings. It should be noted that for ease of description of these specific embodiments, it is unnecessary to detail all the features in the practical embodiments in this specification.

One embodiment of the present disclosure is described hereinafter in detail with reference to FIG. 1 to FIG. 5.

Figure 1:
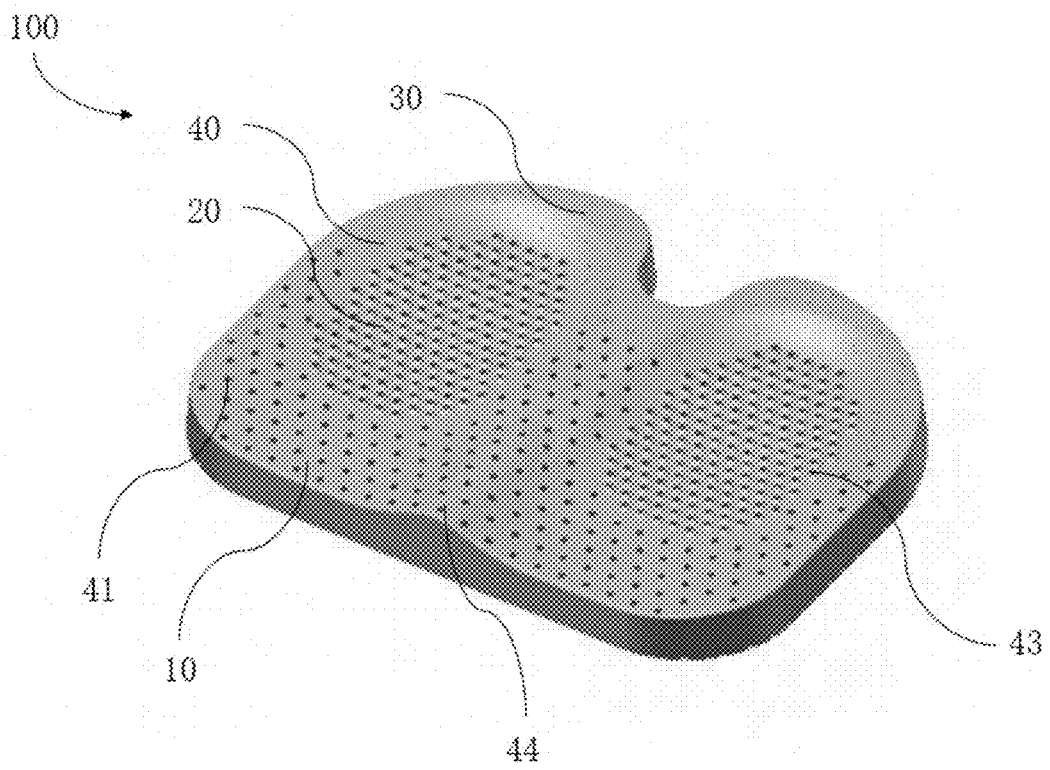
FIG. 1 is a schematic view of a breathable cushion according to an embodiment of the present disclosure.
Figure 2:
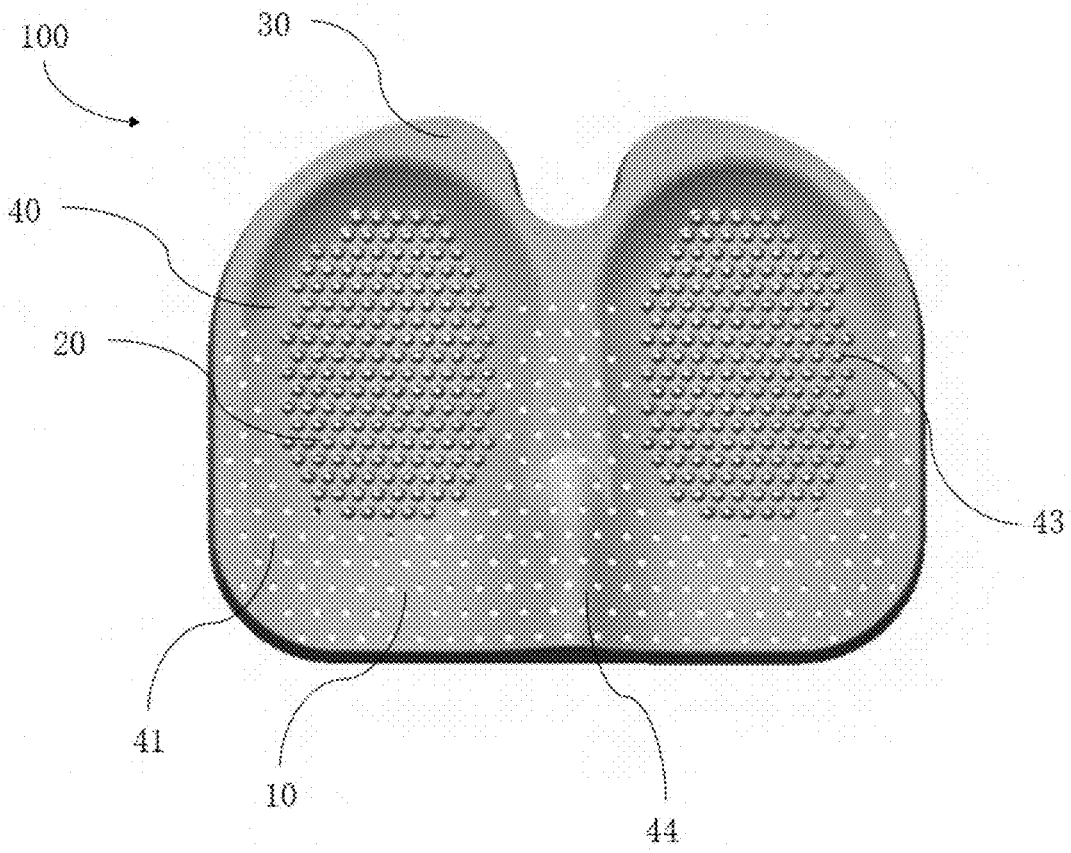
FIG. 2 is a top view of the breathable cushion according to the embodiment of the present disclosure as illustrated in FIG. 1.

One embodiment of the present disclosure relates to a cushion 100 as illustrated in FIG. 1 to FIG. 5. As illustrated in FIG. 1 and FIG. 2, the cushion 100 is integrally formed using a thermoplastic elastomer (TPE) material, and has a smooth surface without any obvious connection traces. The cushion 100 provides good support and excellent comfort. In some other embodiments, the cushion 100 may be made of other materials having high elasticity, high strength, and high resilience, such as, rubber, silica gel, and the like. Dependent on properties of the material, the cushion 100 may also be manufactured and molded in other ways, for example, by 3D printing and the like.

The cushion 100 includes a thigh support portion 10, a hip support portion 20, and a waist and back support portion 30. The thigh support portion 10 is disposed at a front end of the cushion 100, and is mainly configured to support thighs of a user. The high support portion 20 is disposed at a middle part of the cushion 100, and is mainly configured to support hips of the user. The waist and back support portion 30 is disposed at a rear end of the cushion 100, and is mainly configured to support rear ends of the hips and at least a part of a waist and back region of a user.

In some specific embodiments, the cushion 100 further includes a cushion surface structure 40, wherein the cushion surface structure 40 is formed by interconnecting upper portions of the thigh support portion 10, the hip support portion 20, and the waist and back support portion 30, and the cushion surface structure 40 includes a relatively smooth and curved surface. In the embodiment as illustrated in FIG. 1, the cushion surface structure 40 is a TPE film having a thickness of 2 mm. The thigh support portion 10, the hip support portion 20, the waist and back support portion 30, and the cushion surface structure 40 of the cushion 100 are all made of the TPE material, and are manufactured by an integral molding process. The cushion 100 manufactured by this method is capable of distributing a received pressure to the entire cushion surface structure 40, such that a more comfort feeling of sitting and a higher holding force are achieved.

Figure 3:
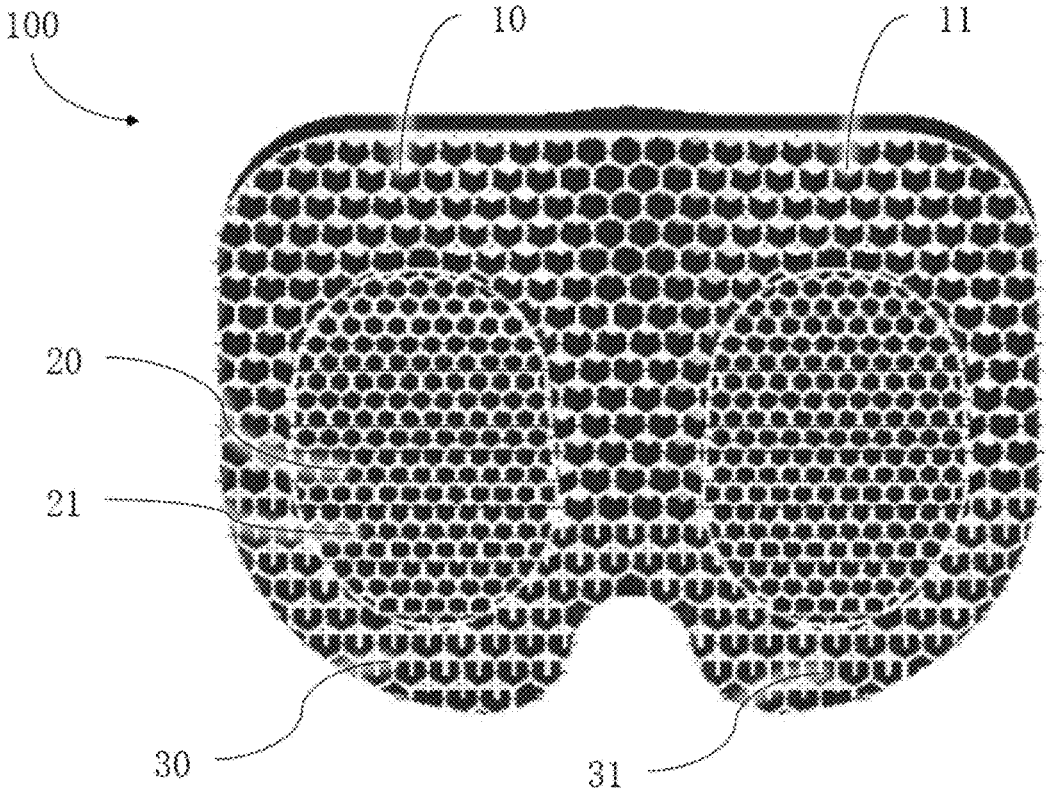
FIG. 3 is a bottom view of the breathable cushion according to the embodiment of the present disclosure as illustrated in FIG. 1.

With reference to a bottom view of the cushion 100 as illustrated in FIG. 3, the thigh support portion 10 includes a plurality of thigh support structures 11 each having an opening structure; the hip support portion 20 includes a plurality of hip support structures 21 each having an opening structure; and the waist and back support portion 30 includes a plurality of waist and back support structures 31 each having an opening structure. The thigh support structures 11, the hip support structures 21, and the waist and back support structures 31 respectively provide a suitable holding force for the corresponding thigh support portion 10, hip support portion 20, and waist and back support portion 30. The opening structure may be a circle, a triangle, a square, a rectangle, a pentagon, an equilateral hexagon, a pentagram, or the like.

In some specific embodiments, the number of the thigh support structures 11 within a unit area is less than the number of the hip support structures 21 within a unit area, or the number of the waist and back support structures 31 within a unit area is less than the number of the hip support structures 21 within a unit area. Alternatively, the number of the thigh support structures 11 within a unit area is less than the number of the hip support structures 21 within a unit area, and the number of the waist and back support structures 31 within a unit area is less than the number of the hip support structures 21 within a unit area.

In some specific embodiments, the opening structures of the thigh support structure 11, the hip support structure 21, and/or the waist and back support structure 31 are all honeycomb openings. In the embodiment as illustrated in FIG. 3, the opening structures of the thigh support structure 11, the hip support structure 21, and/or the waist and back support structure 31 are all honeycomb support structures each having a honeycomb opening.

It is apparent that when the number of the thigh support structures 11 within a unit area and/or the number of the waist and back support structures 31 within a unit area is less than the number of the hip support structures within a unit area, the holding force provided by the thigh support structure 11 and/or the waist and back support structure 31 is less than the support provided by the hip support structure 21. In other words, the holding force provided by the hip support structure 21 for the user is greater than the holding force provided by the thigh support structure 11 and/or the waist and back support structure 31, such that the practical contact hardness is even greater. According to an experimental result of the pressure distribution region with respect to sitting postures of the human body, when the user is sitting, the gravity is mainly distributed on the hips; therefore, a better holding force needs to be provided at the positions of the hips of the user to maintain a reasonable sitting posture, and denser supports need to be provided at the positions withstanding a greater pressure. That is, by providing an even greater holding force at the hip support portion 20, the pressure may be better relieved according to the hip structure of the human body in the aspect of pressure distribution, such that the body of the user may be better supported.

Figure 4:
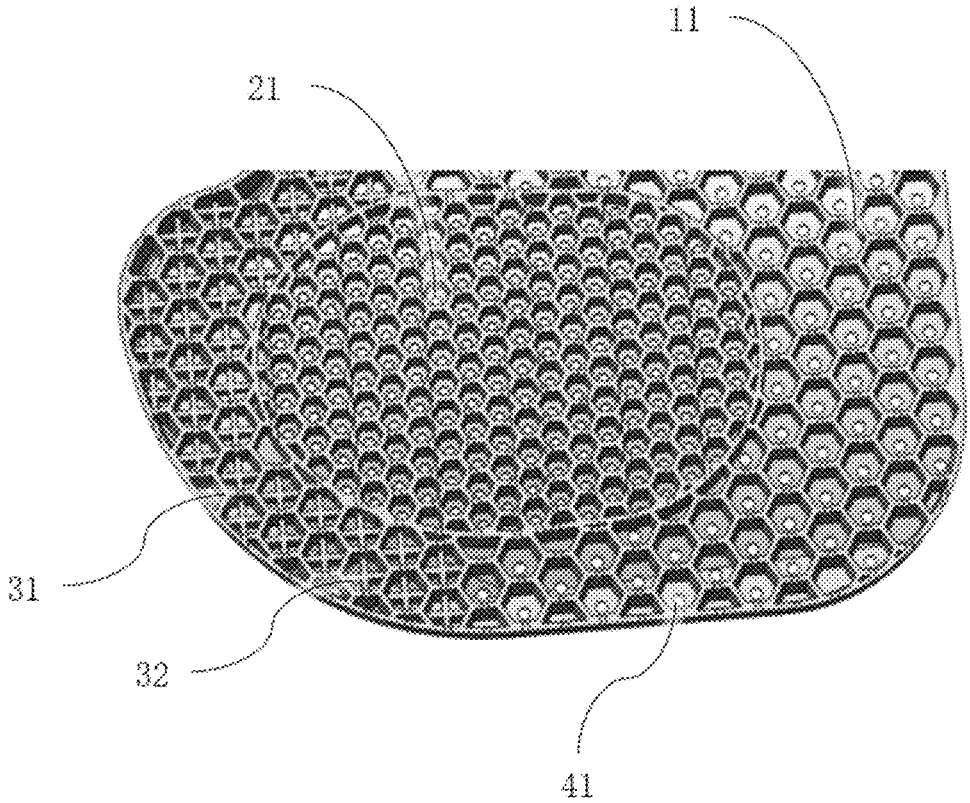
FIG. 4 is an enlarged partial view of a bottom portion of the breathable cushion according to the embodiment of the present disclosure as illustrated in FIG. 1.

As seen from an enlarged partial view of a bottom portion as illustrated in FIG. 4, in some specific embodiments, the opening structures of at least a part of the waist and back support structures 31 further include a cross-shaped support reinforcement structure 32. The cross-shaped support reinforcement structure 32 may improve the holding force provided by the waist and back support structure 31, such that the waist and back support structure 31 better maintains the shape thereof to support the body of the user.

In the embodiment as illustrated in FIG. 1 to FIG. 5, the thigh support portion 10, the hip support portion 20, and the waist and back support portion 30 respectively employ different support fashions, to correspondingly provide suitable holding forces for the thighs, the hips, and the waists and backs. In this way, the user may be provided with a reasonable and comfortable holding force.

In some specific embodiments, an upper surface of the thigh support portion 10 and an upper surface of the hip support portion 20 both further include a plurality of longitudinal through holes 41 longitudinally passing therethrough. The longitudinal through holes may effectively ease the stuffy feeling of the user, and provide a cooling sensation.

Figure 5:
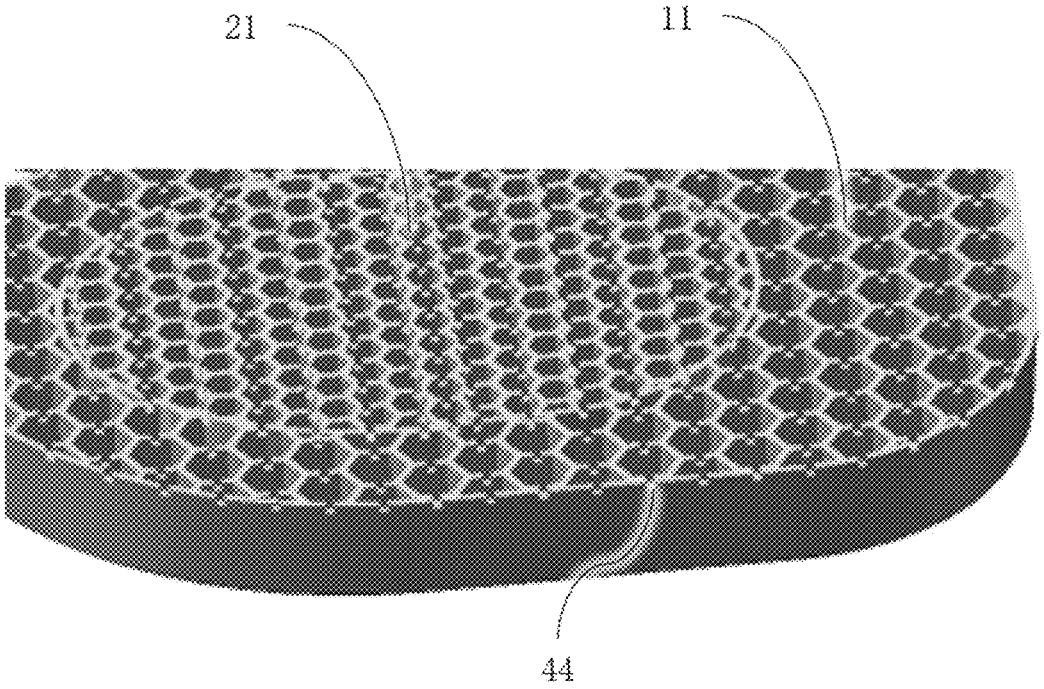
FIG. 5 is another enlarged partial view of the bottom portion of the breathable cushion according to the embodiment of the present disclosure as illustrated in FIG. 1.

As seen from another enlarged partial view of the bottom portion as illustrated in FIG. 5, in some specific embodiments, the cushion 100 further includes a transverse through hole 42 transversely passing through the thigh support portion 10 and the hip support portion 20, wherein the transverse through hole 42 communicates at least a part of the longitudinal through holes 41 with air. Communication with air may further enhance the air permeability of the cushion 100, and thus more comfortable feeling of sitting is provided for the user.

In some specific embodiments, an upper surface of the hip support portion 20 further includes a plurality of protrusion portions 43. The protrusion portion 43 may be a protruded circle, a protruded triangle, a protruded square, or other shapes. In the embodiment as illustrated in FIG. 1 to FIG. 5, circular protrusion portions 43 are employed. The protrusion portion 43 is capable of distributing the force applied to the hips of the user, and achieving a massage effect.

In some specific embodiments, a thickness of at least a part of the thigh support portion 10 is greater than a thickness of the hip support portion 20, such that a tilt angle which decreases from front to rear to accommodate human optimal sitting posture is achieved. For example, the thickness of the main body of the thigh support portion 10 is 45 mm, and the thickness of the main body of the hip support portion 20 is 35 mm. It should be noted that the thicknesses are defined herein as examples, and do not construe any limitation on the thicknesses of the thigh support portion 10 and the hip support portion 20.

In addition, in the middle of the thigh support portion 10, a saddle-shaped protrusion 44 may be further arranged at a position between the thighs of the user, wherein the saddle-shaped protrusion 44 guides the user to a correct sitting posture.

In some specific embodiments, a thickness of at least a part of the waist and back support portion 30 is greater than the thickness of the hip support portion 20. Accordingly, the rear sides of the hips of the user are wrapped, and the waist and back of the user are supported. By wrapping the rear sides of the hips, the user may be guided to a correct sitting posture, and by supporting the waist and back of the user, the user may keep health.

In the embodiment as illustrated in FIG. 1 to FIG. 5, the thickness of a part of the waist and back support portion 30 and the thickness of a part of the thigh support portion 10 are both greater than that of the hip support portion 20, such that the entire cushion 100 is designed to have an arc, and the user may be better supported.

Figure 6:
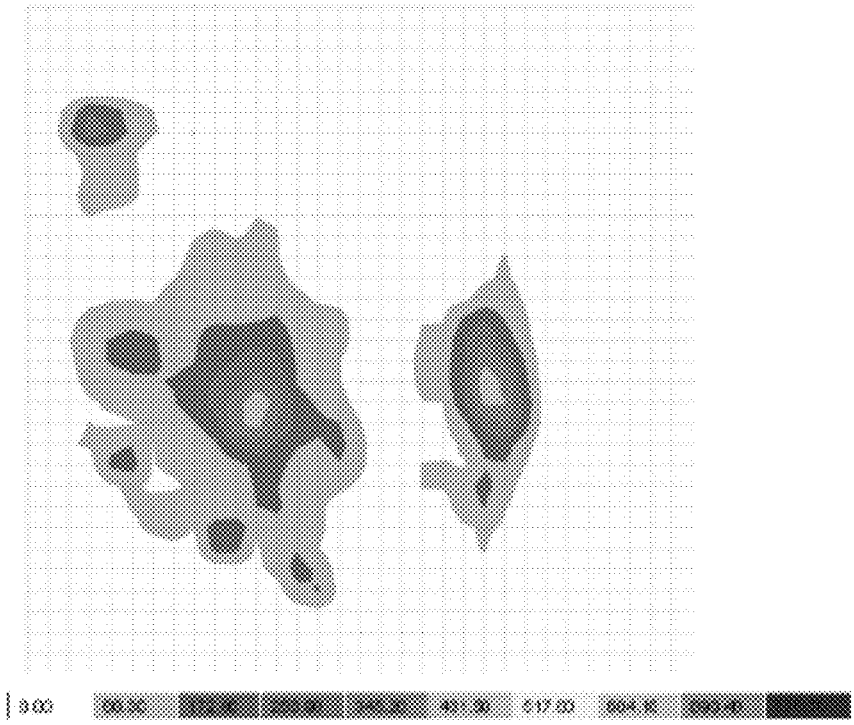
FIG. 6 is a 3D image of pressure distribution measured by an IMM-0014 sensor when a user sits on the cushion according to the present disclosure.
Figure 7:
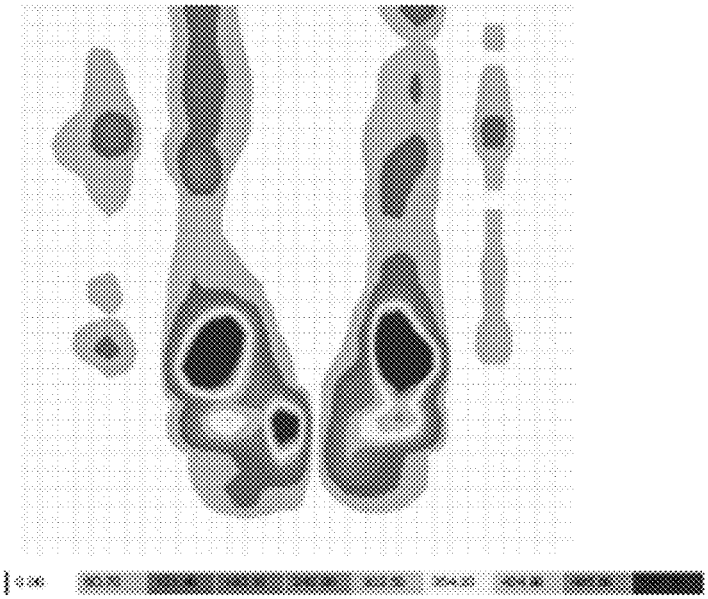
FIG. 7 is a 3D image of pressure distribution when a user directly sits on the IMM-0014 sensor.

For verification the effect that the breathable cushion according to the present disclosure is capable of uniformly distributing the received pressure to the entire cushion surface, 3D pressure distribution when a user sits on the cushion according to the present disclosure is measured by an arrayed piezoresistive thin-film IMM-0014 sensor and associated imaging software SENSOREDGE, as illustrated in FIG. 6. As a comparison, 3D pressure distribution is also measured when a user directly sits on the sensor, as illustrated in FIG. 7. As illustrated in FIG. 7, when a user directly sits on the sensor, the pressure distribution is not uniform, and the pressure at a position in contact with the sensor is the maximum. As illustrated in FIG. 6, when a user sits on the cushion according to the present disclosure, the pressure distribution is uniform. It should be noted that in original 3D distribution, pressures are indicated by different colors, and the pressure progressively increases in an order of blue, green, yellow, and red. Although the colors are not shown in FIG. 6 and FIG. 7, the pressures may also be observed by different gray scales. A greater gray scale indicates a greater pressure.

This specification describes the present disclosure reference to the specific embodiments, including the optimal implementation, and help any person skilled in the art to practice the present disclosure. However, the specification is not intended to limit the scope of the present disclosure.

What is claimed is:

1. A breathable cushion, comprising a thigh support portion, a hip support portion, and a waist and back support portion; wherein the thigh support portion comprises a plurality of thigh support structures each having an opening structure;

the hip support portion comprises a plurality of hip support structures each having an opening structure; and the waist and back support portion comprises a plurality of waist and back support structures each having an opening structure;

wherein the number of the thigh support structures within a unit area is less than the number of the hip support structures within a unit area, or the number of the waist and back support structures within a unit area is less than the number of the hip support structures within a unit area;

alternatively, wherein both of the number of the thigh support structures within a unit area and the number of the waist and back support structures within a unit area are less than the number of the hip support structures within a unit area;

wherein the opening structures of at least a part of the waist and back support structure further comprise a cross-shaped support reinforcement structure.

2. The breathable cushion according to claim 1, wherein the opening structures of the thigh support structure, the hip support structure, and/or the waist and back support structure all comprise a honeycomb opening.

3. The breathable cushion according to claim 1, wherein an upper surface of the thigh support portion and an upper surface of the hip support portion both further comprise a plurality of longitudinal through-holes longitudinally passing therethrough.

4. The breathable cushion according to claim 3, wherein the cushion further includes a transverse through-hole transversely passing through the thigh support portion and the hip support portion, wherein the transverse through-hole communicates at least part of the longitudinal through-holes with air.

5. The breathable cushion according to claim 1, wherein an upper surface of the hip support portion further comprises a plurality of protrusion portions.

6. The breathable cushion according to claim 1, wherein a thickness of at least part of the thigh support portion is greater than a thickness of the hip support portion.

7. The breathable cushion according to claim 1, wherein a thickness of at least part of the waist and back support portion is greater than a thickness of the hip support portion.

8. The breathable cushion according to claim 1, wherein the breathable cushion is integrally formed using a thermoplastic elastomer material.

9. The breathable cushion according to claim 1, further comprising a cushion surface structure, wherein the cushion surface structure is formed by interconnecting upper portions of the thigh support portion, the hip support portion, and the waist and back support portion, and the cushion surface structure comprises a relatively smooth and curved surface.

* * * * *